US006229504B1

(12) United States Patent
Andreev et al.

(10) Patent No.: US 6,229,504 B1
(45) Date of Patent: May 8, 2001

(54) GAS DISCHARGE DISPLAY PANEL OF ALTERNATING CURRENT WITH A REVERSE SURFACE DISCHARGE WITH AT LEAST THREE ELECTRODES AND AT LEAST TWO DISCHARGE GAPS PER DISPLAY COLOR ELEMENT

(75) Inventors: Anatoly Sergeyevich Andreev, Moscow; Robert Pavlovich Baranov, Ryazan; Victor Markusovich Gutman, Ryazan; Vladiimir Pavlovich Yevdokimov, Ryazan; Alexei Nicholayevich Ivlyushkin, Ryazan; Vladimir Dmitriyevich Lipatov, Ryazan; Vladislav Michaelovich Nickolsky, Ryazan; Anatoly Borisovich Pokryvailo, Ryazan; Vladislav Georgievich Samorodov, Ryazan, all of (RU); Chun Woo Lee, Gumi-si (KR)

(73) Assignee: Orion Electric Co. Ltd., Kungsangbuk-do (KR)

( * ) Notice: Subject to any disclaimer, the term of this patent is extended or adjusted under 35 U.S.C. 154(b) by 0 days.

(21) Appl. No.: 09/068,838

(22) PCT Filed: Nov. 22, 1996

(86) PCT No.: PCT/KR96/00211

§ 371 Date: May 19, 1998

§ 102(e) Date: May 19, 1998

(87) PCT Pub. No.: WO97/19438

PCT Pub. Date: May 29, 1997

(30) Foreign Application Priority Data

Nov. 22, 1995 (RU) ..... 95119742

(51) Int. Cl.[7] ..... G09G 3/28; G09G 3/10; H01J 1/52

(52) U.S. Cl. ..... 345/60; 315/169.4; 313/582

(58) Field of Search ..... 345/60, 62, 63, 345/66, 65, 55, 67, 68, 72, 208; 315/169.4, 169.1, 169.2; 313/581, 582, 584, 585

(56) References Cited

U.S. PATENT DOCUMENTS

| | | | | |
|---|---|---|---|---|
| 4,728,864 | * | 3/1988 | Dick | 313/582 |
| 4,866,349 | * | 9/1989 | Weber et al. | 315/169.4 |
| 4,914,352 | * | 4/1990 | Gay et al. | 315/169.4 |
| 5,369,338 | * | 11/1994 | Kim | 315/169.4 |
| 5,663,741 | * | 9/1997 | Kanazawa | 345/66 |
| 5,874,932 | * | 2/1999 | Nagaoka et al. | 345/60 |

FOREIGN PATENT DOCUMENTS

| | | |
|---|---|---|
| 0 350 348 | 1/1990 | (EP) . |
| 0 356 313 | 2/1990 | (EP) . |
| 0 554 172 | 8/1993 | (EP) . |
| 4345733 | 12/1992 | (JP) . |
| 5121001 | 5/1993 | (JP) . |

OTHER PUBLICATIONS

T. Shinoda, et al. "Invited Address: Development of Technologies for Large–Area Color ac Plasma Displays"; SID '93 Digest; pp. 161–164.

G. W. Dick. "Three–electrode–per–pel AC Plasma Display Panel"; IEEE Transaction on Electron Devices; vol. ED–33; 1986; pp. 1169–1173.

* cited by examiner

*Primary Examiner*—Steven Saras
*Assistant Examiner*—Paul A. Bell
(74) *Attorney, Agent, or Firm*—Merchant & Gould P.C.

(57) ABSTRACT

AC Plasma Display Panel with a reverse surface discharge with each display element comprises at least, one display discharge gap formed by the address and common electrodes, and the control and address display electrodes wherein the number of the display is n≧3, and geometric parameters of all above gaps and gas filling is determined from conditions of the reverse surface discharge.

11 Claims, 6 Drawing Sheets

GAS DISCHARGE DISPLAY PANEL OF ALTERNATING CURRENT WITH A REVERSE SURFACE DISCHARGE WITH AT LEAST THREE ELECTRODES AND AT LEAST TWO DISCHARGE GAPS PER DISPLAY COLOR ELEMENT

TECHNICAL FIELD

The invention relates to the field of gas-discharge technology and can be used in means of video information displaying. There is known a gas-discharge display panel wherein every display element includes a display discharge gap produced by an address and common display electrodes being on one glass plate and a controlling discharge gap produced by an address display electrode and a control electrode being on the other glass plate at right angles to the display electrodes with the display elements along the display electrodes being separated from each other by dielectric barrier ribs with the control electrodes between them (See the article Dick G. W. "three-electrode-per-pel AC Plasma Display Panel" IEEE Transaction on electron devices, vol. ED-33 1986, pp 1169–1173).

BACKGROUND ART

The reasons impeding achievement of the technical result required when using the known apparatus relates the fact that in the known apparatus there are no conditions to improve luminous efficiency. There is a gas-discharge display panel of alternating current (AC plasma display panel) wherein every display element comprises a display discharge gap produced by protrusions on an address and common display electrodes being on one glass plate and a controlling discharge gap produced by an address display electrode and control electrode being on the other glass plate at the right angle to the display electrodes over the protrusions on them (See the patent EU no. 0536 313 A1 issued on Feb. 28, 1990 cl GO9 G3/28).

The reasons impeding achievement of the technical results required when using the known apparatus relates to the fact that in the known apparatus:

there are no conditions for improvement of light efficiency, low predictability because of necessity to make protrusion on display electrode and precis registration of them with control electrodes arranged on the other glass plate and low color contrast when displaying color video information due to a lack of separating barrier ribs between display elements with photoluminescent phosphors of different colors. There is an ac plasma display panel with each display element comprising a display discharge gap formed by protrusion on the address and common display electrodes arranged on the glass plate, and the control electrode arranged on the same plate over the display electrodes and at a right angle to them, with the display electrodes and the control electrode being separated from each other by a dielectric layer, and the control electrodes are being coated by a dielectric layer (See the patent EU NO. 0530 348 A1 issued on Jan. 10, 1990 cl HO1 J17/49).

The reasons impeding achievement of the technical result required when using the known apparatus relates to the facts that in the known apparatus: there are no conditions to improve luminous efficiency, low productability of the design due to the necessity of making a protrusion on the display electrodes and increased amplitude of discharge sustain voltage impulses and driving because of two dielectric layers being over the display electrodes.

There is an AC plasma display panel with each display element comprising a display discharge gap formed by the address and common display electrodes arranged on one glass plate and a controlling discharge gap formed by the address display electrode and the control electrode arranged on the other glass plate at a right angle to the display electrodes, with the control electrodes being arranged between the dielectric barrier ribs with their height defining the space between the glass plates and in display elements being photoluminescent phosphors deposited on the control electrodes and walls of dielectric barrier ribs (See the patent EU no. 0554 172 A1 issued on Jan. 27, 1993 cl MO1 J17/49).

The reasons impeding achievement of the technical result when using the known apparatus as a prototype relates to the fact that in the known apparatus there are no conditions for the improvement of luminous efficiency.

DISCLOSURE OF INVENTION

The invention's essence consists of the following: The present invention is directed to decision of the task of enhancing performance, particularly the improvement of an image brightness and the lowering of power consumption of a flat screen based on a plasma display panel and promotion competitive capability with CRTs in the displaying of video information.

The technical result possible to be archived with the embodiment of this invention consists of improvement of luminous efficiency of the AC plasma display panel. The given technical result during the embodiment of the invention is achieved by the fact that in the known plasma display panel with a surface discharge each display element comprises at least, one display discharge gap formed by the address and common display electrodes and the controlling discharge gap formed by the control and address display electrodes wherein the improvement consists of the number of display discharge gaps in each display element being n−1 the number of display electrodes in $n \geqq 3$, and geometric parameters of all the above gaps and gas filling have been determined by the condition of the embodiment in a display element of a reverse surface discharge.

With the total number of the display electrodes in a display element being equal to three, one of the electrodes is used as an address electrode, and the lateral electrodes are used as common display electrodes, with the common display electrodes of the plasma display panel being united in two groups so that the common display electrodes of one and the same display element belong to different groups, and all display electrodes have inputs to be connected to a multi-phase source of the discharge support voltage pulses made with feasibility to ensure a timing pulse shift for a reverse change in the direction of a surface discharge transfer over all display gaps of display element, and the control and address display electrodes have inputs to be connected to a source of control pulses, each display element comprising a photoluminescent phosphor deposited outside the direct discharge zone in the display discharge gaps, the distance between any adjacent display electrodes in a display element being the same, and the width of the common display electrodes is equal to the width of the address display electrodes, and the width of the control electrodes is equal to the width of the address display electrodes.

Existence in a display element of several, and in particular, two display discharge gaps the number being a unit less than the total number of the display electrodes when providing conditions to achieve a reverse change in direction of a surface discharge transfer from one extreme display electrode to the other and back, makes it possible to provide a successive excitation of a photoluminescent phosphor over the whole area of the display element thereby improving luminescence. No magnification of a pulse amplitude of the discharge sustain voltage occurs at the expense of additional losses of charged particles onto the walls of a display element in comparison to the case in which the increase of the distance between the display electrodes in the known plasma display panels with one display discharge gap in a display element. Improvement of luminescence brightness in a plasma display panel according to the present invention also results from excitation of a photoluminescent phosphor in adjacent display discharge gaps of a display element during transferring of a surface discharge over it with the reverse change in direction making a contribution to reduction of power consumption. The selection must be an equal distance in a display element and between any adjacent display electrodes of the plasma display panel. An equal width of the common address display electrodes and also the control and address display electrodes provides optimal conditions for developing and sustaining a discharge in all discharge gaps of the plasma display panel excluding enlargement of pulse amplitudes of discharge currents and voltages, and high productability of the design. Thus, a block of important features of the present invention provides increase in the area brightness and reduction of power consumption, that is, provides improvement of luminous efficiency.

BRIEF DESCRIPTION OF THE DRAWINGS

The invention will be better understood and other advantages procured by it will appear from the following description, given as a non-restrictive example, and made with reference to the appended drawing in which.

BEST MODE OF FOR CARRYING OUT THE INVENTION

Figure 1:
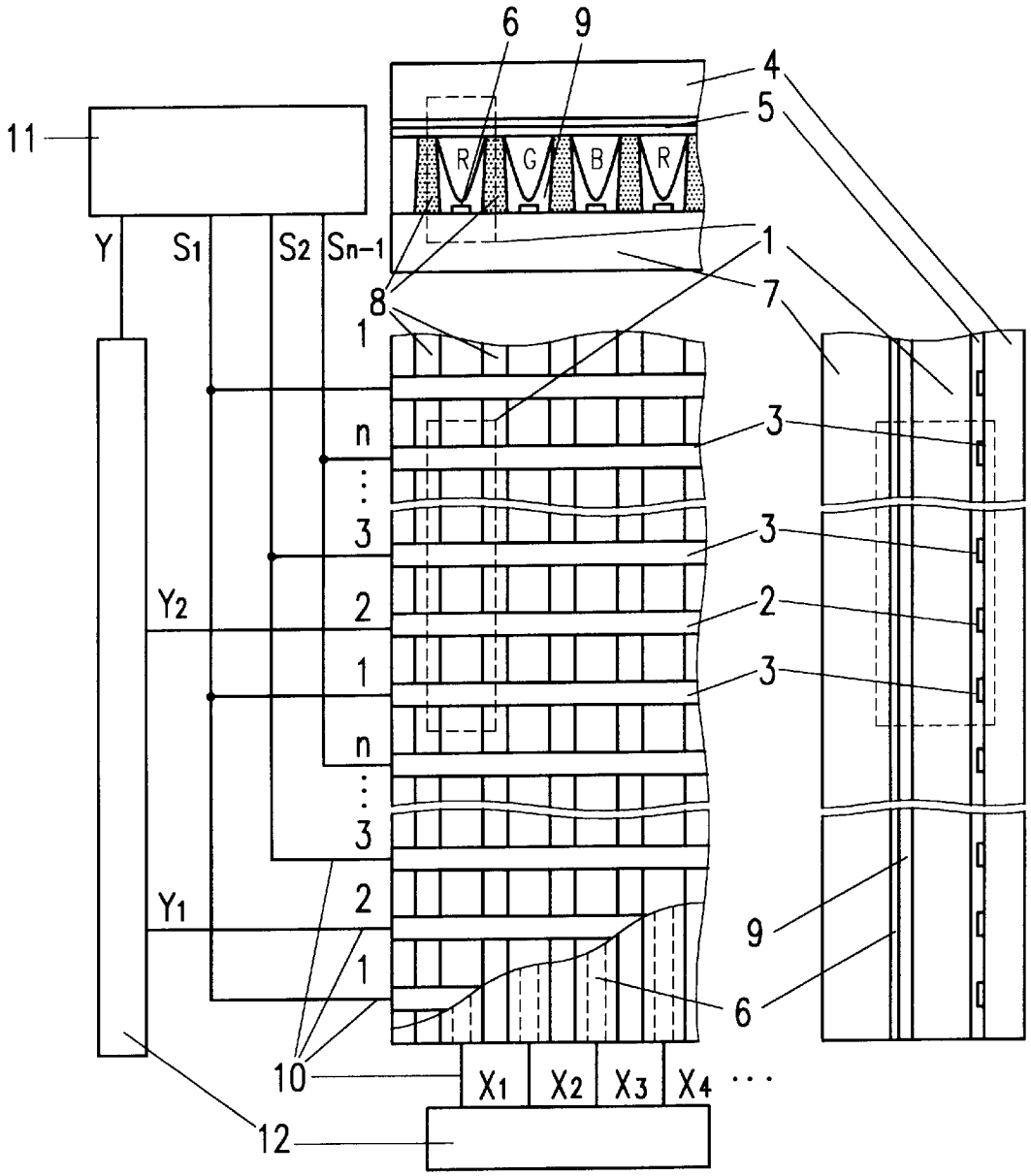
FIG. 1 shows the plasma display panel design with n-display electrodes in a display element.

FIG. 1 shows the design of a plasma display panel, each display element 1 comprising n−1 display discharge gaps formed by the address display electrode 2 and the common display electrodes 3 being arranged on the glass plate 4 and coated by a layer of a transparent dielectric 5. The controlling discharge gap is formed by the address display electrode and the control electrode 6, being arranged on the glass plate 7 between the dielectric barrier ribs and on the control electrode photoluminescent phosphor 9, which is coated with for example, a red R, green G or blue B luminescence color. All display electrodes of the gas plasma display have the inputs 10 to be connected to the multi-phase source of discharge sustain voltage pulses 11, and the address display electrodes and the control electrodes to the source of pulses 12.

Figure 2:
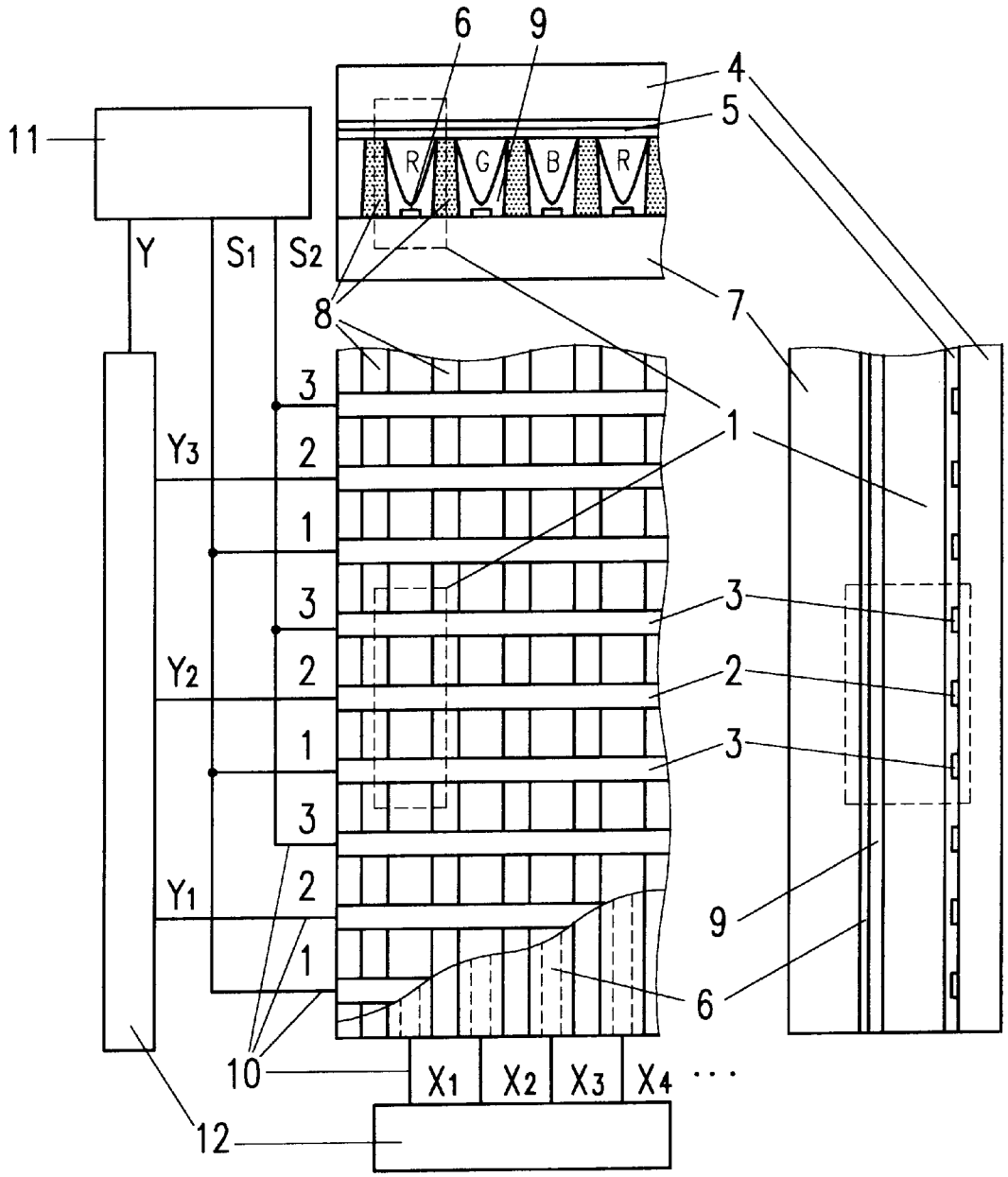
FIG. 2 shows the design of the plasma display panel with 3 display electrodes in a display element.

FIG. 2 shows the design of the gas plasma display panel each display element 1 comprising two display discharge gaps formed by the address display electrode 2 and two common display electrodes 3. The address display electrode is arranged in the middle (center) of the display element. The common display electrodes of the plasma display panel arranged at the edges of the display elements are united into two groups, thereby the common display electrodes of one and the same display element belong to different groups.

The rest the design of plasma display panels shown in FIG. 1 and FIG. 2 are analogous.

The plasma display panel shown in FIG. 2 operates as follows.

Figure 3:
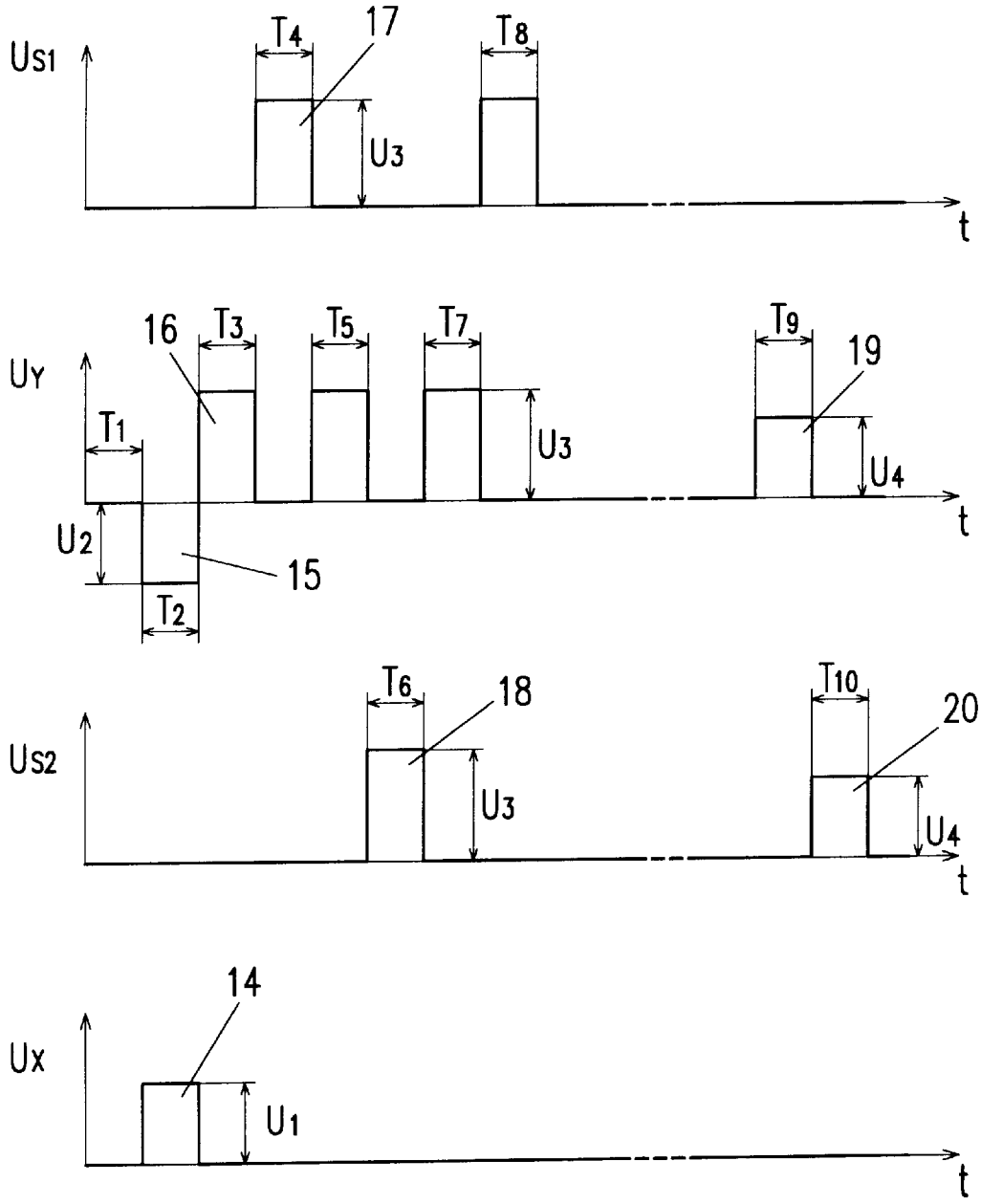
FIG. 3 shows the timing diagrams of voltage pulses for a display element with three display electrodes.
Figure 4:
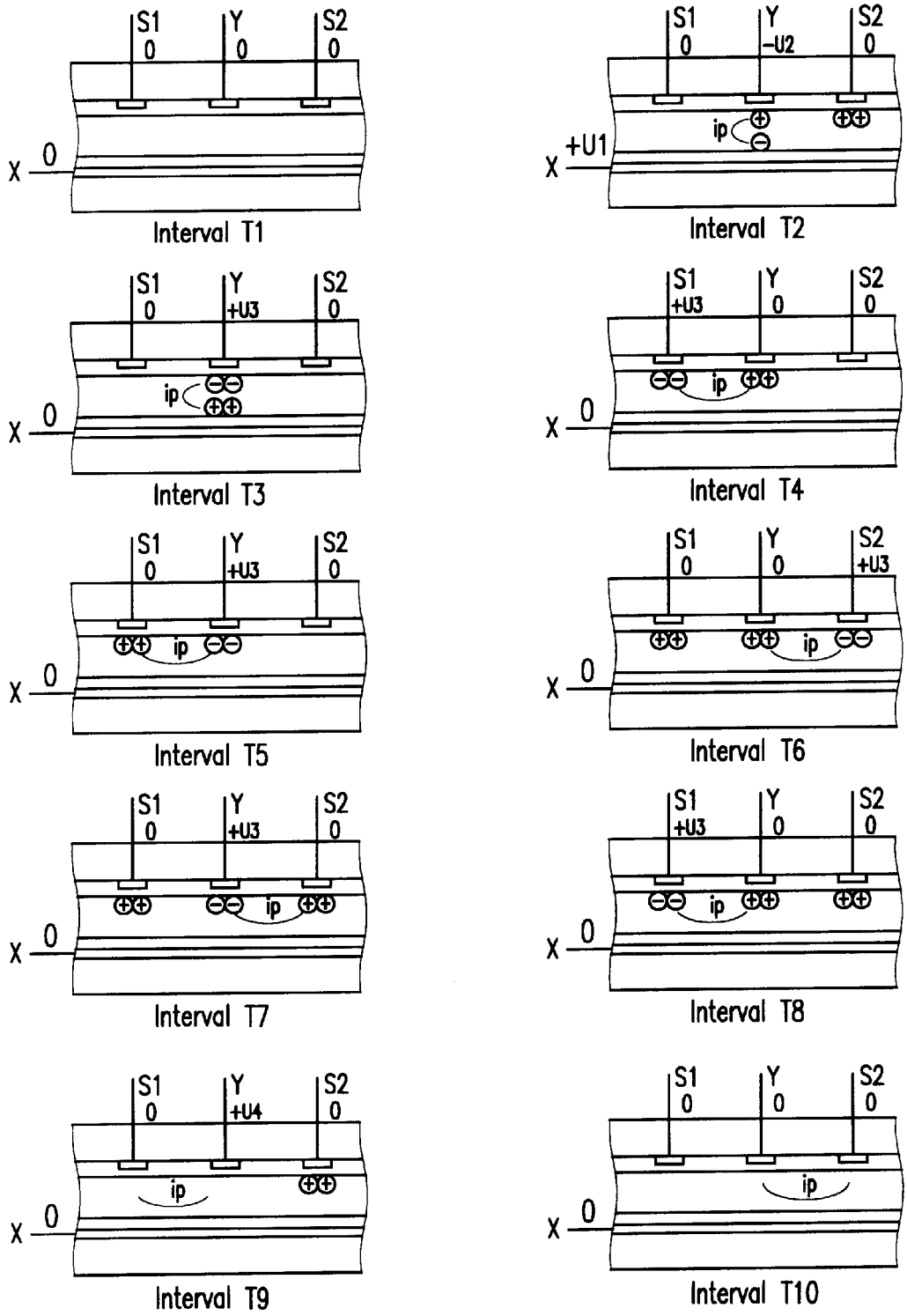
FIG. 4 shows the diagrams of electric charge states for a display element with 3 display electrodes.

In the initial position with time interval T1 (FIG. 3) voltages on the display and control electrodes being equal to zero, the electric charges in a display element is zero too (FIG. 4). In the time interval T2, a control pulse of positive polarity 14 of the amplitude U1 is applied to the control electrode, and to the address display electrode a control pulse of negative polarity 15 of the amplitude U2 is applied and they give rise to a discharge current in the controlling discharge gap "$I_d$" and a positive electric charge on the dielectric over the address display electrode. In the time interval T3, the control electrode voltage is set to be equal to zero, a discharge sustain voltage pulse 16 of amplitude U3 applied to address display electrode is giving rise to a discharge in the controlling display gap and change of charges in a display element, and as a result the charge on the photo-luminescent phosphor becomes zero on the dielectric becoming of a negative value and being of more magnitude in the interval T2.

In the interval T4, the discharge sustain voltage pulse 17 with the amplitude U3 is applied to the common electrode S1 giving rise to a discharge in the display discharge gap between the address display electrode and the common display electrode S1, and, respectively, to the origin of electric charges of polarity shown in FIG. 4.

In the interval T5, the discharge sustain voltage pulse is again applied to the address display electrode, with reversal of charges polarity on the dielectric taking place.

In the interval T6, the discharge sustain voltage pulse 18 of the amplitude U3 is applied to the common display electrode S2 giving rise to origin of a charge of negative polarity on the dielectric over this electrode and of positive polarity over the address display electrode.

In the interval T7, at the expense of the discharge sustain voltage pulse, reversal of charges polarity occurs on the address display electrode ever the electrodes in the discharge gap formed by the address display electrode and the common display electrode.

In the interval T8, a discharge is created in the display discharge gap between the address display electrode and the common display electrode S1, the charges polarity being reversed in this gap. Then, cycles of charges polarity reversals over the display electrodes are reported at the expense of the discharge sustain voltage pulse shifted in time being applied to them with that during passing of the discharge currents UV-radiation of a gas discharge excites the photo-luminescent phosphor being in the display element addressed and, respectively, its luminescence.

The display element luminescence ceases after successive supply of the erase pulses 19 and 20 of the amplitude U4<U3 to the display electrodes in the time interval T9 and T10 resulting in the taking-off of electric charges from the dielectric. With that, the display element returns to the original state with a zero electric charges.

Thus, after the supply of the drive pulses before the taking-off of the changes from the dielectric in the display element under influence of the discharge sustain pulses pulsed takes place the reverse charge in direction of the surface discharge transfer in all display discharge gaps of the display element.

Figure 5:
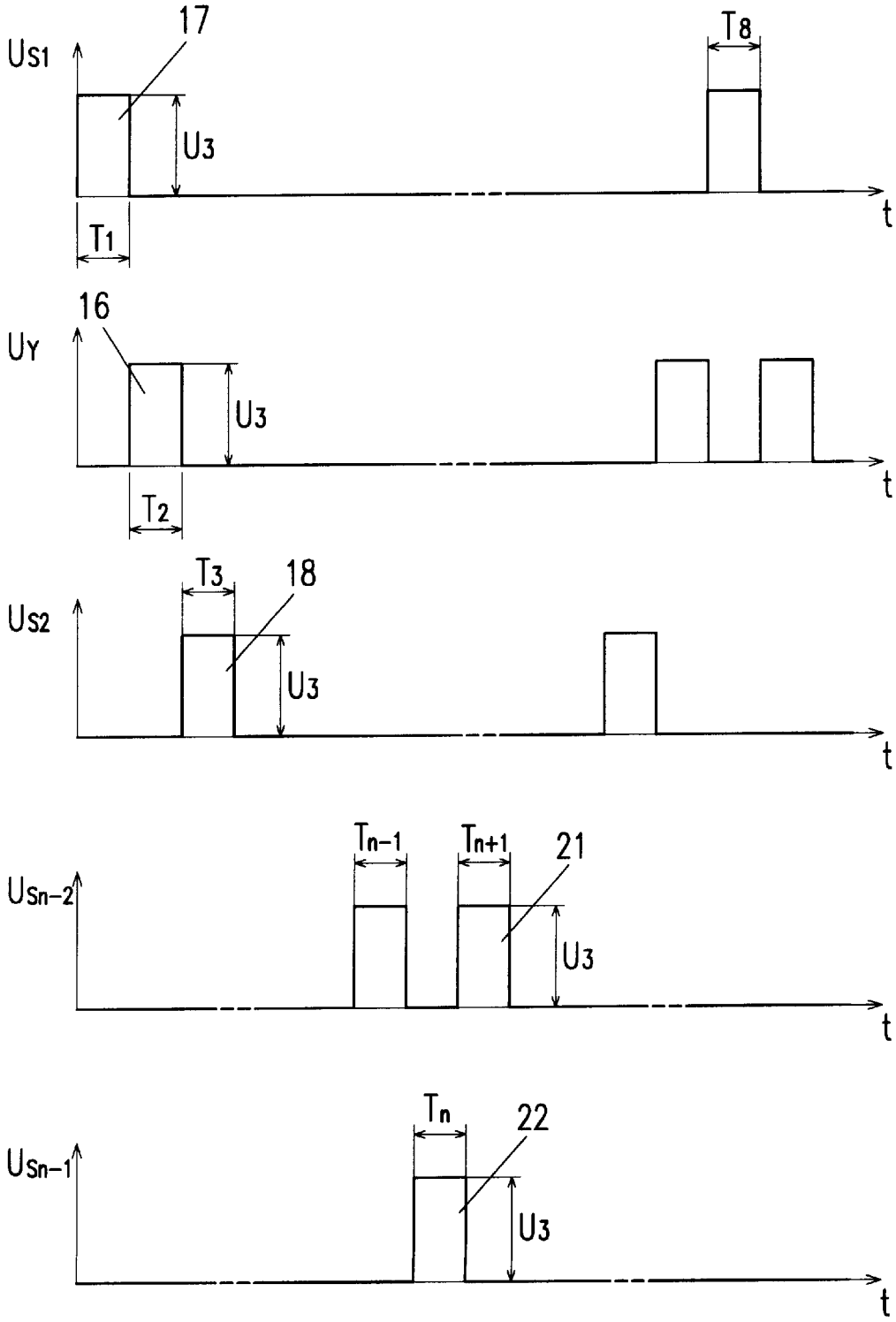
FIG. 5 shows timing diagrams of discharge sustain voltage pulses.
Figure 6:
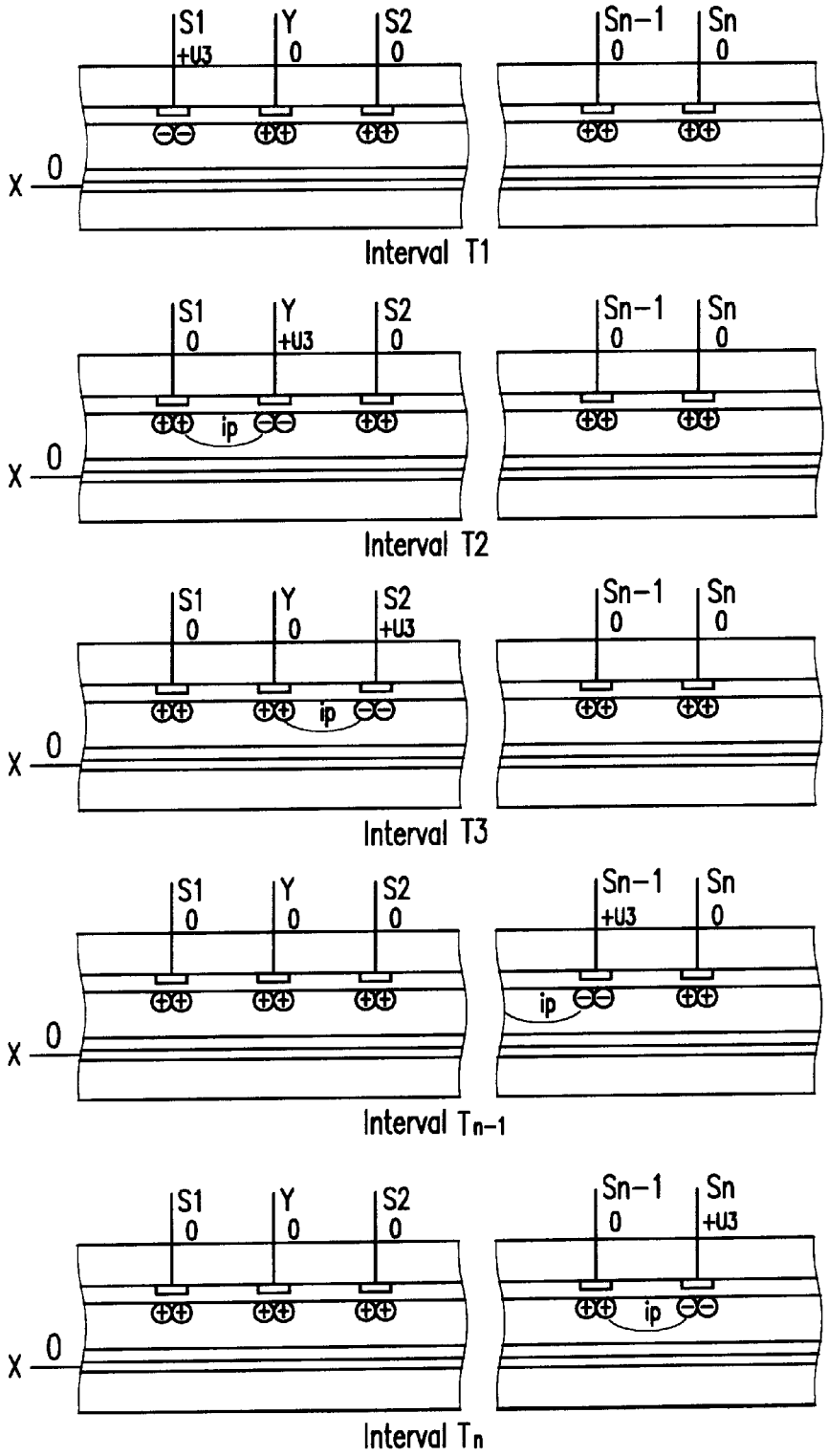
FIG. 6 shows the diagram of electric charge states for a display element with n-display electrodes.

The process of electric charges polarity reversal on the dielectric over the display electrodes with the supply of the discharge sustain voltage pulses 16,17,18,21,22 (FIG. 5) to them for the display element with the n−1 display gaps is shown in FIG. 6 and it is similar with the analogous process in FIG. 4. With that the initial origin of electric charges in the controlling discharge gap and the taking off of charges from the dielectric occurs similarly as in the case wherein it has been considered for a display element with two discharge gaps.

As an example, the confirmation of the performance of the invention of a plasma display panel being of the analogous design shown in FIG. 2 has been made and investigated.

The address display electrodes 2 and the common display electrode 3 are made with a 280 μm pitch on a glass substrate 4 in the form of conductive lines with the width of 100 μm with the dielectric coating 5 with width of 40 μm being coated on them. To protect the dielectric from ion bombardment a MgO-layer with a thickness of 0.4 μm has been deposited. The total number of the address and the display electrodes is 1050, and it makes it possible to generate 350 lines.

The control electrodes 6 are made with a 280 μm pitch on the glass substrate 7 in the form of conductive lines with a width of 100 μm therebetween with the dielectric barrier ribs 6 with the width of 100 μm and the height of 150 μm have been formed. On the surfaces of the control electrodes and on the walls of the dielectric barrier ribs, the photoluminescent phosphor 9 of three main colors have been deposited. The total number of the control electrodes is 1440 pieces and it makes it possible to form 480 three-color columns.

Both glass plates are stacked and sealed along the perimeter and the discharge gap between the plates is filled with a mixture of the inert gases He+1% Xe up to the pressure of 500 mm of Mg column.

The luminescent brightness of the given plasma display panel is white and is not less than 300 cd/m2 at the discharge sustain voltage pulse rate of 30 kHz, received as a prototype, under other similar conditions is 200 cd/m2 with the comparable value of the power consumed (See the article T Sinoda et. al. "Invited Address: Development of technologies for large area color AC Plasma Displays" SID '93 Digest p 161–164).

What is claimed is:

1. AC Plasma Display Panel with a reverse surface discharge with each display element comprising, at least, one display discharge gap formed by an address display electrode and a common display electrode, and a controlling discharge gap formed by a control electrode and an address display electrode, wherein the number of adjacent display discharge gaps in each display element is n−1 with the number of the address display electrodes and common display electrodes being $n \geqq 3$ arranged in one plane, the distance between the display discharge gaps of the adjacent display element along the control electrodes being chosen n−1 times less than the distance between external edges of the display electrodes at the edges of the display element.

2. AC Plasma Display Panel according to claim 1, wherein all of the address display electrodes and common display electrodes have inputs to be connected to a multiphase source of discharge sustain voltage pulses made with a capability for timing shift of pulses for a reverse charge in direction of transfer of surface discharge in all display discharge gaps of the display element, and the control electrodes and the address display electrodes have inputs to be connected to a control pulse source.

3. AC Plasma Display Panel according to claim 1, wherein the total number of the address and common display electrodes in the display element is equal to three electrodes, one of the display electrodes is used as the address display electrode, and lateral electrodes are used as the common display electrodes, the common display electrodes of the display panel being united in two groups in a way that the common display electrodes of the one and same display element belong to different groups.

4. AC Plasma Display Panel according to claim 1, wherein each display element comprises a photophosphor arranged outside a direct zone in the display discharge gaps.

5. In AC Plasma Display Panel with a reverse surface discharge with a plurality of display elements, each of said display elements comprising at least one display discharge gap formed by an address display electrode and a first/second common display electrode, and a controlling discharge gap formed by a control electrode and the address display electrode, wherein the number of adjacent display discharge gaps in each display element is two with the number of the address display electrode and common display electrodes is three, the distance between the display discharge gaps of the adjacent display element along the control electrode being chosen two times less than the distance between external edges of the common display electrodes at the edges of the display element, a method of operating said AC Plasma Display Panel comprising following steps:

a) setting voltages on the address and common display electrodes and the control electrode, wherein an initial electric charges in said display element is zero;

b) applying a control pulse of positive polarity to the control electrode, and a control pulse of negative polarity to the address display electrode;

c) setting voltage of the control electrode to zero, and applying a discharge sustain voltage pulse to the address display electrode;

d) applying the discharge sustain voltage pulse to the first common display electrode;

e) applying the discharge sustain voltage pulse to the address display electrode;

f) applying the discharge sustain voltage pulse to the second common display electrode;

g) applying the discharge sustain voltage pulse to the address display electrode;

h) applying the discharge sustain voltage pulse to the first common display electrode;

i) applying an erase pulse to the address display electrode; and j) applying the erase pulse to the second common display electrode.

6. The method of operating said AC Plasma Display Panel according to claim 5, wherein the address display electrode gives rise to a discharge current in the controlling discharge gap and a positive electric charge on the dielectric over the address display electrode during step b).

7. The method of operating said AC Plasma Display Panel according to claim 5, wherein the address display electrode gives rise to a discharge in the controlling display gap during step c).

8. The method of operating said AC Plasma Display Panel according to claim 5, wherein the first common display electrode gives rise to a discharge in the display discharge gap formed by the address display electrode and the first common display electrode during step d).

9. The method of operating said AC Plasma Display Panel according to claim 5, wherein the second common display electrode gives rise to a charge of negative polarity on the dielectric over said second common display electrode and that of positive polarity over the address display electrode during step f).

10. The method of operating said AC Plasma Display Panel according to claim 5, wherein the address display electrode gives rise to a reversal of charges polarity on the address display electrode in the display discharge gap formed by the address display electrode and the second common display electrode at the expense of the discharge sustain voltage pulse occurs during step g).

11. The method of operating said AC Plasma Display Panel according to claim 5, wherein the first common display electrode gives rise to a discharge in the display discharge gap formed by the address display electrode and the first common display electrode and a reversal of the charges polarity in said display discharge gap during step h).

* * * * *